United States Patent [19]

Auras

[11] 4,288,960

[45] Sep. 15, 1981

[54] INTERLOCKING BUILDING BLOCK

[76] Inventor: Olivier W. Auras, 2 Rue Du Nord, Martigny (Valais), Switzerland, 1920

[21] Appl. No.: 820,671

[22] Filed: Aug. 1, 1977

[51] Int. Cl.[3] ..... E04B 5/04; E04C 2/04

[52] U.S. Cl. ..... 52/604; 52/594; 52/606; 52/608; 52/DIG. 10; 404/41

[58] Field of Search ..... 404/34, 41, 42; D25/92, D25/93; 46/24, 25; 52/DIG. 10, 593, 594, 590, 608, 606, 607, 604

[56] References Cited

U.S. PATENT DOCUMENTS

| | | | |
|---|---|---|---|
| 77,208 | 4/1868 | Parson | 404/34 |
| 123,385 | 2/1872 | Demom | D25/92 X |
| 228,052 | 5/1880 | Frost | 46/24 X |
| 257,155 | 5/1882 | Dupuis | 52/593 |
| 903,906 | 11/1908 | Soss | D25/96 |
| 1,379,440 | 5/1921 | Brainerd | 404/34 |
| 2,665,387 | 1/1954 | Bartow | 52/593 X |
| 3,010,888 | 11/1961 | Battle | D25/93 X |
| 3,229,439 | 1/1966 | Strobel | 52/594 X |
| 3,435,576 | 4/1969 | Giannelia | 52/590 X |
| 3,568,387 | 3/1971 | Grabow | D25/93 X |
| 3,611,620 | 10/1971 | Perry | 52/DIG. 10 |
| 3,783,571 | 1/1974 | Horvath | 52/593 X |
| 3,785,096 | 1/1974 | Neuhardt | 52/DIG. 10 |

FOREIGN PATENT DOCUMENTS

| | | | |
|---|---|---|---|
| 905399 | 9/1962 | United Kingdom | 52/606 |

OTHER PUBLICATIONS

"Order in Space", Keith Critchlow, Appendix 2.

*Primary Examiner*—Leslie Braun
*Attorney, Agent, or Firm*—Henri J. A. Charmasson

[57] ABSTRACT

A rectangular building block with surface indentations corresponding to a geometrical arrangement of rhombic dodecahedral elements. The indentations are designed to interlock closely with those of the adjoining blocks in order to provide a mortarless bond.

4 Claims, 8 Drawing Figures

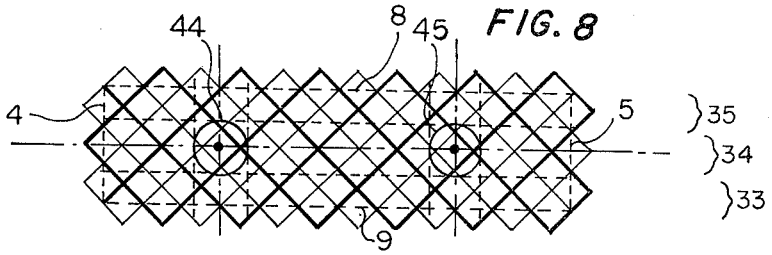
FIG. 8
FIG. 6
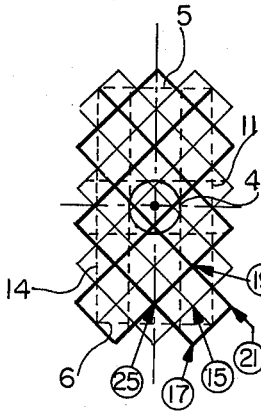
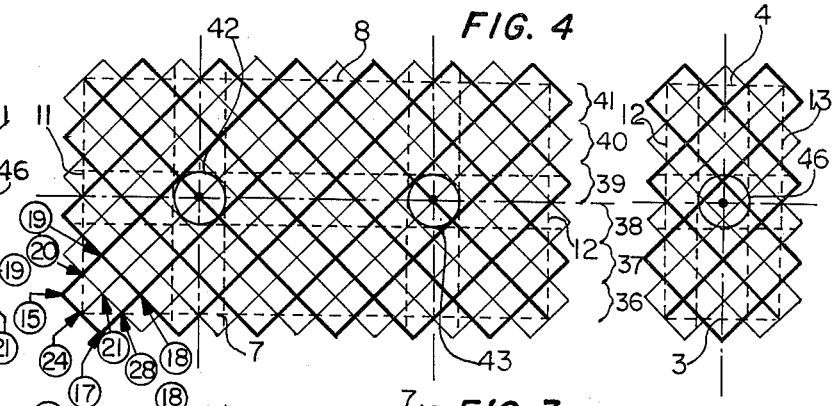
FIG. 4
FIG. 5
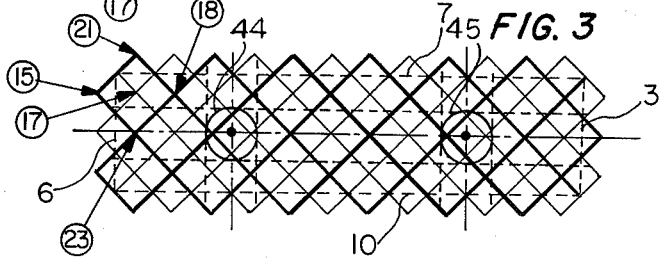
FIG. 3
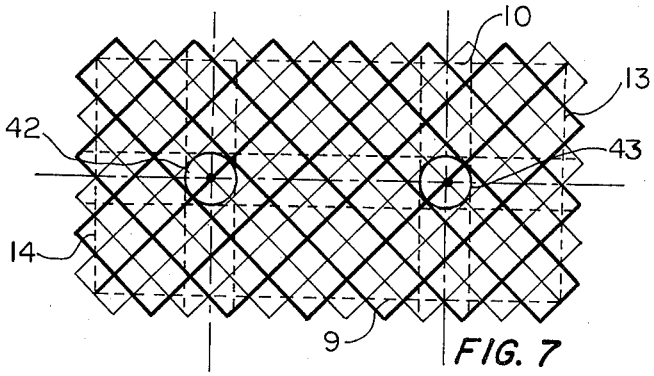
FIG. 7

INTERLOCKING BUILDING BLOCK

BACKGROUND OF THE INVENTION

Building blocks have been provided with some type of interlock between them to assist in retaining them in their proper locked location as they are laid upon or adjacent to one another. In the past there have been made many attempts in the selection of a geometrical design for building blocks, which will provide a good bond while retaining as much of the practicality and versatility of the rectangular building block. The common red clay brick has a length corresponding to twice its width and to thrice its thickness, taking into account the necessary mortar space. It follows that such a brick lends itself to many symetrical patterns in the layout of floors or walls and thus makes a very practical building element.

Presently existing interlocking building blocks on the other hand, can often be used in only one or very few arrangements by reason of their assymetrical shapes or uncoordinated dimensions.

SUMMARY OF THE INVENTION

The proposed invention provides a building block with a interlocking geometrical design on all its faces while retaining the practicality and versatility of the conventional rectangular bricks and building blocks.

The disclosed building block can be stacked or arranged in many different patterns like a conventional brick. Its interlocking surface indentations allow for the construction of mortarless walls, flood control channels and emergency dikes. The block is particularly useful for the consolidation of embankments as well as the creation of decorative patterns on the surfaces of walls or ceilings and in the construction of bearing walls in earthquake prone areas. Such an interlocking block facilitates the construction of sound-proof rooms and dark rooms, without wall interstices.

Made of lead, parafine graphite or any other radiation absorbing material, the proposed blocks can be used by scientists and technicians working around radioactive materials for constructing temporary shielding walls without gaps through which radiations could escape.

The proposed design can also be used in the packaging of consumer products for ornamental, promotional, and storage related practical reasons.

Finally a collection of such blocks in reduced dimensions can make a fascinating and mind challenging toy.

IN THE DRAWING

FIG. 3 is a frontal elevation of the building block.

FIG. 4 is a top view thereof.

FIG. 5 is a right side view thereof.

FIG. 6 is a left side view thereof.

FIG. 7 is a bottom view thereof.

FIG. 8 is a back view thereof.

DESCRIPTION OF THE PREFERRED EMBODIMENT

Figure 1:
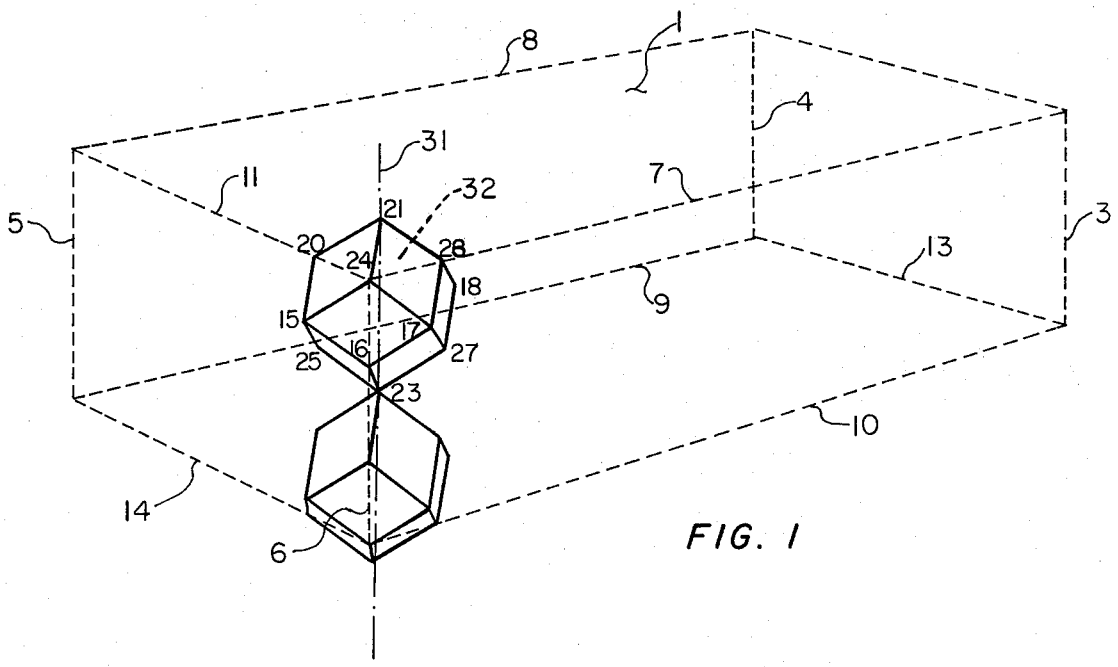
FIG. 1 is a perspective view of the general shape of the building block, showing the geometrical orientation of the basic poyhedral element.

Referring now to the drawing, there is shown a building block which has the general shape of a rectangular solid 1 but whose outline discloses surface indentations aranged in a symetrical geometrical pattern. The outline corresponds, in fact, to the agglutination of several layers of identical polyhedral elements interlocked to one another. More specifically, the elements are rhombic dodecahedrons although other types of symetrical polyhedrons could have been used.

Figure 2:
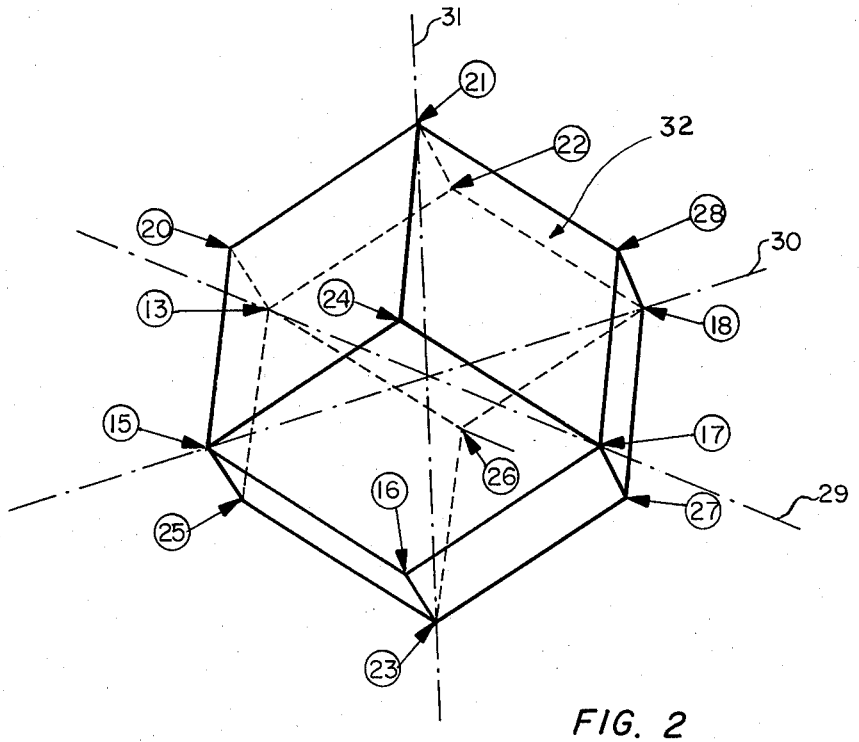
FIG. 2 is a frontal (perspective) view of a rhombic dodecahedron.

Note that all polyhedral elements have the same orientation which is more specifically revealed in FIGS. 1 and 2. Examining the dodecahedral element 32 located at the upper front right corner of the block 1, one can observe that the axis 31 which joins the two diagonally opposite vertices 21 and 23 is parallel to vertical edges 3, 4, 5 and 6 of the rectangular solid 1; that the axis 30 which joins the two diagonally opposite vertices 15 and 18 is parallel to horizontal edges 7, 8, 9 and 10 of the rectangular solid 1; and that the axis 29 which joins the two diagonally opposite vertices 17 and 19 is parallel to horizontal edges 11, 12, 13 and 14 of the rectangular solid 1. The faces defines by vertices 19, 20, 15, 25, by vertices 15, 24, 17, 16, by vertices 17, 28, 18, 27 and by vertices 18, 22, 19, 26 are parallel to axis 31 and are located in planes which forms forty-five degree angles with the longitudinal edges 7, 8, 9, 10 and with latitudinal edges 11, 12, 13, 14 of the rectangular solid 1.

Referring now, more specifically to FIGS. 3 through 8 it can be observed that the building block ressembles the agglutination of one hundred eight polyhedral elements. Although the number of elements can be varied and arranged in different combinations, the arrangement illustrated in the drawing appears to be the most practical.

The elements are positioned in three interlocking strata 33, 34, 35. Each stratum comprises six interlocked rows 36 through 41. Each row includes six dodecahedral elements joined at opposite vertices.

It follows that in the building block 1 the second largest dimension (edges 11, 12, 13 and 14) is a multiple of the smallest dimension (edges 3, 4, 5 and 6), and that the largest dimension (edges 7, 8, 9 and 10) is a multiple of the second largest dimension.

Transversal holes 42, 43, 44, 45, 46 may be provided through the center of the various faces to engage the building block on steel rods used as guides or braces in the construction of walls.

Although the invention has been described with a certain degree of particularity, it is understood that the present disclosure has been made only by way of example and that numerous changes in the details of construction and the combination and arrangement of elements may be resorted to without departing from the spirit and scope of the invention.

What is claimed is:

1. A building block having the general shape of a six sided rectangular solid and an outline corresponding to the agglutination of a plurality of interlocked identical elements each having the form of a symmetrical rhombic dodecahedron wherein each said rhombic dodecahedron is positioned so that two of its diagonally opposite vertices are in an axis parallel to a first edge of said rectangular solid and each of the faces parallel to said axis is in a plane forming a forty-five degree angle with the other edges of said rectangular solid which are perpendicular to said first edge.

2. The building block claimed in 1 wherein the length, width, and depth dimensions of said rectangular solid are of different sizes and wherein the second largest dimension is a multiple of the smallest dimension and the largest dimension is a multiple of the second largest dimension.

3. The building block claimed in 2 wherein said agglutination comprises one hundred eight elements positioned in three interlocking strata each comprising six interlocking rows of elements.

4. The building block claimed in 3 having at least a transversal hole in the center of a face.

* * * * *